US009926897B2

(12) United States Patent
Ohashi et al.

(10) Patent No.: US 9,926,897 B2
(45) Date of Patent: Mar. 27, 2018

(54) FUEL PUMP MODULE

(71) Applicant: DENSO CORPORATION, Kariya, Aichi-pref. (JP)

(72) Inventors: Masaharu Ohashi, Takahama (JP); Toshihiko Muramatsu, Chiryu (JP)

(73) Assignee: DENSO CORPORATION, Kariya (JP)

( * ) Notice: Subject to any disclaimer, the term of this patent is extended or adjusted under 35 U.S.C. 154(b) by 1094 days.

(21) Appl. No.: 14/168,380

(22) Filed: Jan. 30, 2014

(65) Prior Publication Data

US 2014/0227082 A1 Aug. 14, 2014

(30) Foreign Application Priority Data

Feb. 12, 2013 (JP) ..... 2013-24211

(51) Int. Cl.

| | |
|---|---|
| ***F02M 37/08*** | (2006.01) |
| ***F02M 37/10*** | (2006.01) |
| ***F04D 29/42*** | (2006.01) |
| ***F04D 13/06*** | (2006.01) |
| ***F04D 29/66*** | (2006.01) |
| ***F04D 29/70*** | (2006.01) |
| *F02M 37/22* | (2006.01) |

(52) U.S. Cl.

CPC ..... *F02M 37/10* (2013.01); *F04D 13/06* (2013.01); *F04D 29/4293* (2013.01); *F04D 29/669* (2013.01); *F04D 29/708* (2013.01); *F02M 2037/228* (2013.01)

(58) Field of Classification Search

CPC ..... F02M 37/10; F02M 37/103; F02M 37/08; F02M 2037/228; F04D 29/4293; F04D 29/708; F04D 29/669; F04D 13/06

See application file for complete search history.

(56) References Cited

U.S. PATENT DOCUMENTS

| | | | | |
|---|---|---|---|---|
| 6,216,734 | B1 | 4/2001 | Umetsu et al. | |
| 6,840,231 | B2 * | 1/2005 | Suzuki | F02M 37/103 123/509 |
| 2004/0144705 | A1 | 7/2004 | Yamada et al. | |

FOREIGN PATENT DOCUMENTS

| | | |
|---|---|---|
| JP | 2000-45900 | 2/2000 |
| JP | 2009-97388 | 5/2009 |
| JP | 2012-57557 | 3/2012 |

OTHER PUBLICATIONS

Machine trnaslation of JP 2000045900 Okabe Feb. 15, 2000.*

(Continued)

*Primary Examiner* — Woody Lee, Jr.
*Assistant Examiner* — Maxime Adjagbe
(74) *Attorney, Agent, or Firm* — Nixon & Vanderhye P.C.

(57) ABSTRACT

A fuel pump module includes a suction filter, a fuel pump portion having an end part opposing the suction filter, and a holding member allowing the fuel pump portion to rotate around a central axis of the fuel pump portion and restricting the fuel pump portion from moving in an axis direction. A convex part protruding toward the suction filter is defined at the end part of the fuel pump portion. The holding member is positioned between the fuel pump portion and the suction filter and has a concave part, in which the convex part is inserted, such that a clearance is defined between the convex part and the concave part in a radial direction. The convex part has a tip end capable to be in contact with the concave part in the axis direction.

9 Claims, 8 Drawing Sheets

(56) References Cited

OTHER PUBLICATIONS

Office Action (3 pages) dated Mar. 12, 2015, issued in corresponding Japanese Application No. 2013-024211 and English translation (4 pages).

* cited by examiner

FUEL PUMP MODULE

CROSS REFERENCE TO RELATED APPLICATION

This application is based on Japanese Patent Application No. 2013-24211 filed on Feb. 12, 2013 the disclosure of which is incorporated herein by reference in its entirety.

TECHNICAL FIELD

The present disclosure relates to a fuel pump module.

BACKGROUND

Conventionally, a fuel pump module is known to pump fuel from a fuel tank to an internal combustion engine (hereafter referred to as an engine). The fuel pump module has a suction filter removing a foreign material from the fuel, a pump part raising a pressure of the fuel, a pump case housing the pump part, and a bracket positioned between the pump part and the suction filter. For example, Japanese Patent No. 4273324 (corresponding to US 2004/0144705 A1) describes a fuel pump module having a bracket defined integrally with a suction filter. The bracket holds an end part of a pump part opposing the suction filter and a connecting part at which the pump part and the suction filter are connected with each other.

However, according to the fuel pump module of Japanese Patent No. 4273324, a rotation movement of the pump part produces vibration, and the vibration is transmitted to a pump case housing the pump part and the suction filter via the bracket. When the vibration is transmitted to a fuel tank housing the fuel pump module, the noise may become more large.

SUMMARY

According to a first example of the present disclosure, there is provided a fuel pump module having a suction filter, a fuel pump portion, a pump case, and a holding member. The suction filter removes a foreign material included in fuel supplied from a fuel tank to an internal combustion engine. The fuel pump portion raises a pressure of fuel in the suction filter and discharges the fuel to the internal combustion engine. The fuel pump portion has an end part opposing the suction filter, and a convex part protruding toward the suction filter is defined at the end part. The pump case houses the fuel pump portion. The holding member allows the fuel pump portion to rotate around a central axis of the fuel pump portion and restricts the fuel pump portion from moving in an axis direction. The holding member is positioned between the fuel pump portion and the suction filter, and has a concave part, in which the convex part is inserted, such that a clearance is defined between the convex part and the concave part in a radial direction. The convex part has a tip end capable to be in contact with the concave part in the axis direction.

According to the fuel pump module of the present disclosure, the convex part defined at the end part of the fuel pump portion opposing the suction filter is inserted in the concave part of the holding member. The convex part has the tip end which is able to contact the concave part in the axis direction and a clearance is defined between the convex part and the concave part in a radial direction. Therefore, the fuel pump portion can be rotated in the pump case. Accordingly, a vibration produced by a rotation movement of the fuel pump portion is restricted from transmitting to the pump case via the holding member. Therefore, a vibration transmitted from the fuel pump portion to the fuel tank via the pump case is reduced, and the noise can be reduced.

According to a second example of the present disclosure, there is provided a fuel pump module having a suction filter, a fuel pump portion, a pump case, and a holding member. The suction filter removes a foreign material included in fuel supplied from a fuel tank to an internal combustion engine. The fuel pump portion raises a pressure of fuel in the suction filter and discharges the fuel to the internal combustion engine. The fuel pump portion has an end part opposing the suction filter, and a convex part protruding toward the suction filter is defined at the end part. The pump case houses the fuel pump portion. The holding member allows the fuel pump portion to rotate around a central axis of the fuel pump portion and restricts the fuel pump portion from moving in an axis direction. The holding member is positioned between the fuel pump portion and the suction filter. The suction filter has an element removing a foreign material, and a connecting part connecting the element to the fuel pump portion. The connecting part has a bottomed-tubular portion. The convex part is inserted in the bottomed-tubular portion of the connecting part such that a clearance is defined between the convex part and the bottomed-tubular portion in a radial direction. The convex part has a tip part that is capable to be in contact with the bottomed-tubular portion in the axis direction.

According to a third example of the present disclosure, there is provided a fuel pump module having a suction filter, a fuel pump portion, a pump case, a holding member, and a connecting member. The suction filter removes a foreign material included in fuel supplied from a fuel tank to an internal combustion engine. The fuel pump portion raises a pressure of fuel in the suction filter and discharges the fuel to the internal combustion engine. The pump case houses the fuel pump portion. The holding member allows the fuel pump portion to rotate around a central axis of the fuel pump portion and restricts the fuel pump portion from moving in an axis direction. The holding member is positioned between the fuel pump portion and the suction filter. The connecting member connects the holding member and the pump case with each other.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Embodiments of the present disclosure will be described hereafter referring to drawings. In the embodiments, a part that corresponds to a matter described in a preceding embodiment may be assigned with the same reference number, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 1:
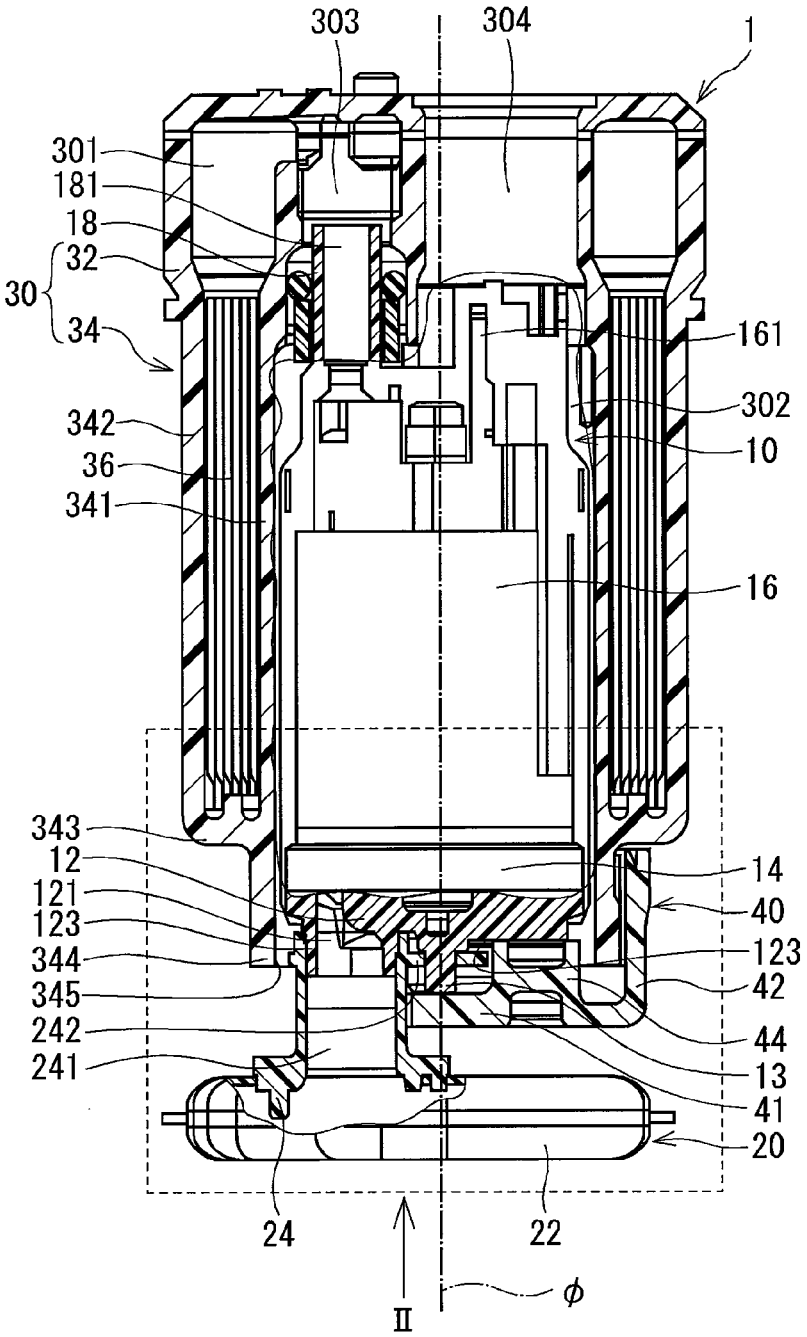
FIG. 1 is a schematic cross-sectional view illustrating a fuel pump module according to a first embodiment.
Figure 2:
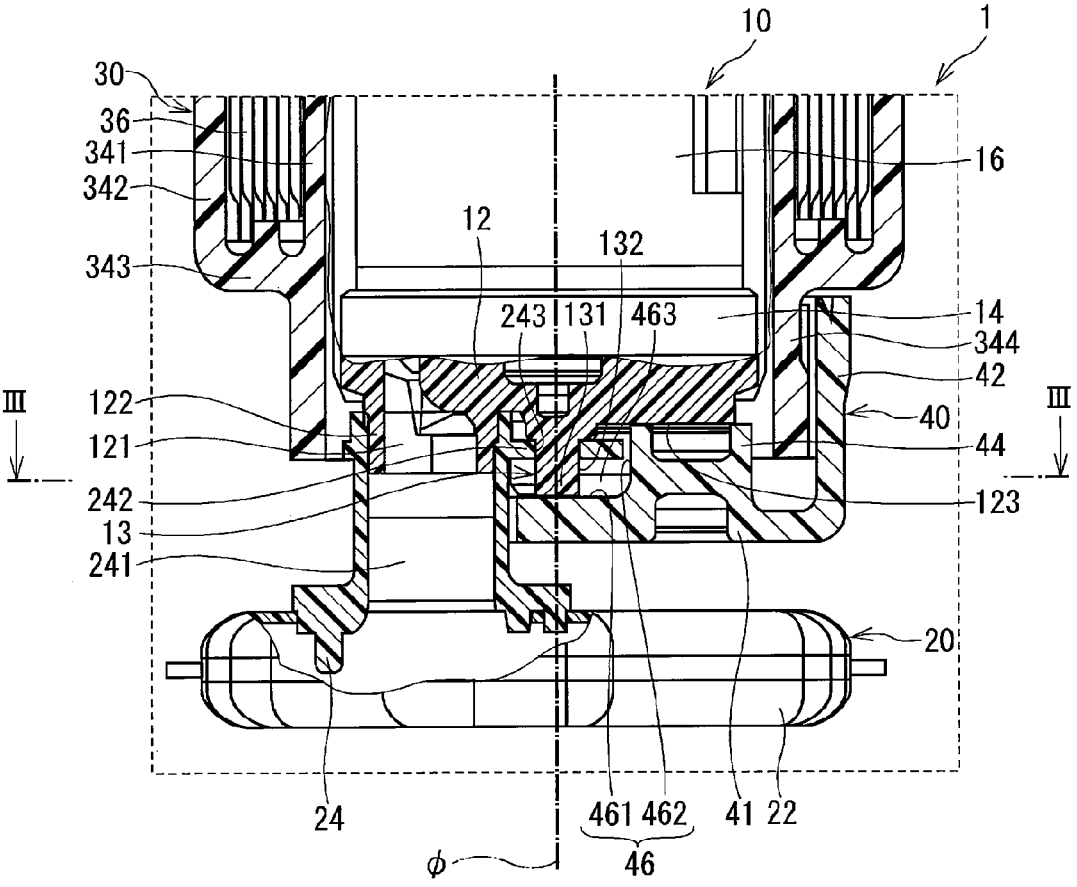
FIG. 2 is an enlarged view of a part II of FIG. 1.
Figure 3:
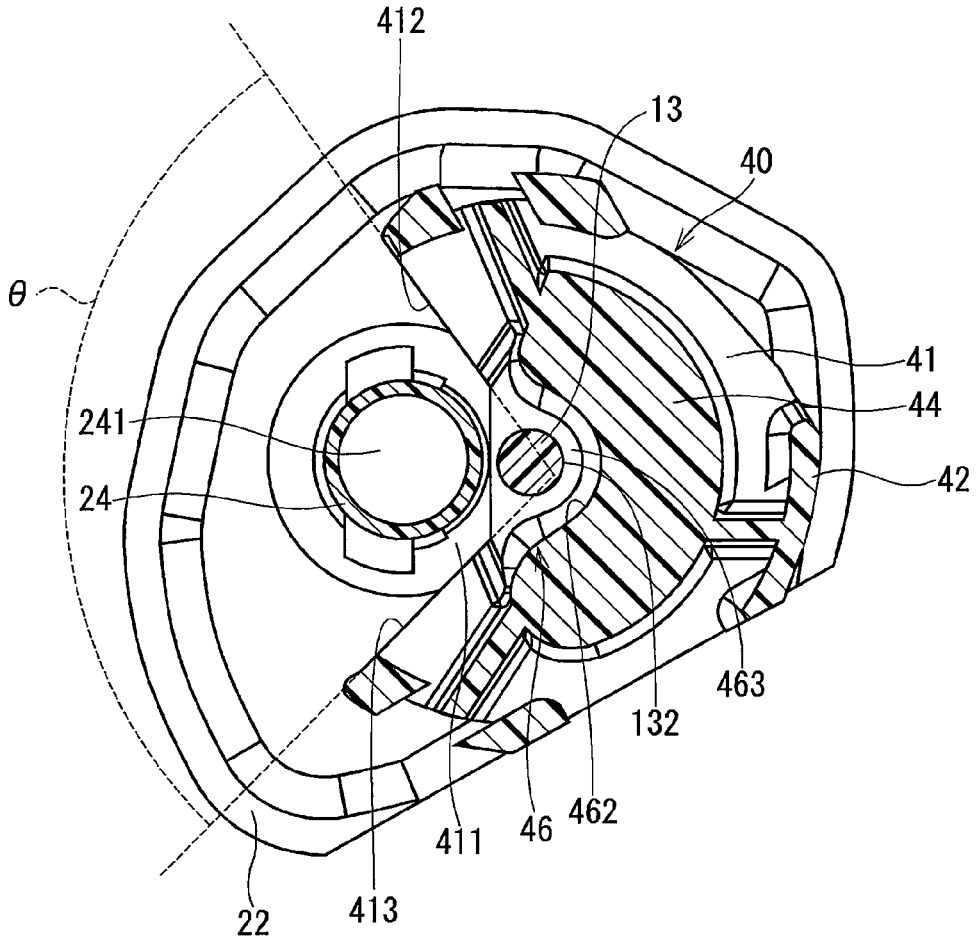
FIG. 3 is a cross-sectional view taken along a line III-III of FIG. 2.

FIGS. 1-3 show a fuel pump module 1 of a first embodiment. The fuel pump module 1 pumps a fuel stored in a fuel tank (not shown) and raises a pressure of the fuel. The fuel of which pressure is raised in the fuel pump module 1 is discharged outside the fuel pump module 1 and supplied to an internal combustion engine (i.e., an engine) (not shown) of a vehicle.

The fuel pump module 1 has a fuel pump portion 10, a suction filter 20, a pump case 30, a bracket 40, and the like.

The fuel pump portion 10 is an electric pump disposed at a generally center of the fuel pump module 1. The fuel pump portion 10 has an intake part 12, a pump part 14, a motor part 16, a discharge part 18, and the like.

The intake part 12 of the fuel pump portion 10 is located adjacent to the suction filter 20. The intake part 12 is connected to the pump part 14 of the fuel pump portion 10. The intake part 12 is an end part of the fuel pump portion 10 opposing the suction filter 20 and includes an intake port defining part 122 defining an intake port 121. The intake port 121 connects the suction filter 20 and the pump part 14 with each other so that inside of the suction filter 20 and inside of the pump part 14 communicate with each other through the intake port 121. The intake port 121 is disposed at a location not overlapping with a central axis φ of the fuel pump portion 10 and supplies the fuel stored in the fuel tank to the pump part 14 via the suction filter 20.

The intake part 12 has a bottom section 123 adjacent to the suction filter 20, and the bottom section 123 has a convex part 13. The convex part 13 is disposed on the central axis φ of the fuel pump portion 10 or to be coaxial with the central axis φ of the fuel pump portion 10 to protrude from the bottom section 123 toward the suction filter 20. The convex part 13 is defined to be able to touch (contact) the bracket 40 positioned between the fuel pump portion 10 and the suction filter 20.

The discharge part 18 is positioned on a side of the pump part 14 that is opposite to the intake part 12 and on a side of the motor part 16 that is opposite to the intake part 12. The discharge part 18 has a discharge port 181 connecting the pump part 14 to the pump case 30 so that inside of the pump part 14 and inside of the pump case 30 communicate with each other. The pump case 30 has a fuel passage 301 defined inside the pump case 30, and a fuel of which pressure is raised by the pump part 14 is supplied to the fuel passage 301 via the discharge port 181.

The pump case 30 is made of resin to have a bottomed-tubular shape. The pump case 30 includes a bottom part 32, a side part 34, and the like. A space 302 housing the fuel pump portion 10 is provided inside the pump case 30.

The bottom part 32 is made of resin to have a discoid shape. The bottom part 32 has a through-hole 304 extending to be generally parallel with the central axis φ. An outside connector (not shown), which is electrically connected to a conducting terminal 161 of the motor part 16, is inserted in the through-hole 304. A connecting port 303 is defined at a position of the bottom part 32 corresponding to the discharge port 181 to communicate with the fuel passage 301. The connecting port 303 communicates with the discharge port 181 and supplies a fuel discharged from the discharge port 181 to the fuel passage 301.

The side part 34 has an inner wall part 341, an outer wall part 342, a bottom part 343, and an opening part 344. The inner wall part 341, the outer wall part 342, and the bottom part 343 provide an annular space having an inside opening open to the bottom part 32. The annular space houses a fuel filter 36 defined to have a generally annular shape. The fuel filter 36 removes a foreign material included in fuel introduced by the connecting port 303 and supplied to the fuel passage 301. The opening part 344 is disposed to extend from the bottom part 343 to be located adjacent to the suction filter 20, and the opening part 344 has an opening 345 opened to the suction filter 20. The fuel pump portion 10 is inserted in the pump case 30 via the opening 345 and housed in the pump case 30.

The suction filter 20 includes an element 22 having a sack shape, a connecting part 24 having a generally tubular shape, and the like. The suction filter 20 removes a foreign material, which is included in the fuel stored in the fuel tank, in the element 22. The connecting part 24 is disposed between the element 22 and the fuel pump portion 10 and is connected to the intake port defining part 122 defining the intake port 121. The connecting part 24 defines a connecting port 241, and the connecting port 241 connects the element 22 to the intake port 121 of the fuel pump portion 10 so that inside of the element 22 and the intake port 121 communicate with each other. The connecting part 24 includes a guide part 242 generally perpendicular to the central axis φ of the fuel pump portion 10. A guide hole 243 is defined in the guide part 242, and has an axis corresponding to the central axis φ. The convex part 13 is inserted in the guide hole 243.

The bracket 40 is made of resin and positioned between the intake part 12 of the fuel pump portion 10 and the element 22 of the suction filter 20, separately from the fuel pump portion 10, the suction filter 20, and the pump case 30. The bracket 40 is an example of a holding member and configured by a base 41, which is an example of a base part, a wall part (e.g., an outer periphery part 42), a supporting part 44, a concave part 46, and the like. The bracket 40 is fixed to a radially-outer wall surface of the pump case 30.

As shown in FIG. 3, the base 41 has a notch part 411 and is defined to have a generally sector shape. Specifically, the base 41 includes a first end surface 412 and a second end surface 413, and the first end surface 412 and the second end surface 413 provide the notch part 411. A center angle θ produced by the first end surface 412 and the second end surface 413 is smaller than 180°. The connecting part 24 of the suction filter 20 is positioned at the notch part 411 so that the connecting part 24 and the intake part 12 of the fuel pump portion 10 are connected with each other.

As shown in FIG. 2, the outer periphery part 42 is defined to extend from a radially-outer edge of the base 41 along an outer wall surface 346 of the opening part 344 of the pump case 30. The outer periphery part 42 has a snap-fit part (not shown) and is connected to the opening part 344 of the pump case 30 through the snap-fit part.

The supporting part 44 is disposed radially-inward of the outer periphery part 42 to define an arc shape, as shown in FIG. 3. As shown in FIG. 2, the supporting part 44 extends from the base 41 toward the fuel pump portion 10 and is able to be in contact with the bottom section 123 of the fuel pump portion 10.

The concave part 46 is positioned at a generally center of the bracket 40. The concave part 46 is configured by a bottom surface 461 and a side surface 462. The bottom surface 461 is positioned to oppose the fuel pump portion 10, and a tip part 131 of the convex part 13 is able to be in contact with the bottom surface 461. The side surface 462 of the concave part 46 is defined by the radially inner wall surface of the supporting part 44. A clearance 463 is provided between a side surface 132 of the convex part 13 and the side surface 462 of the concave part 46 in the radial direction.

An operation of the fuel pump module 1 will be described below.

The fuel pump portion 10 has the conducting terminal 161, and an electric power is supplied from outside to the fuel pump portion 10 via the conducting terminal 161. A motor (not shown) in the motor part 16 produces a rotation torque based on the electric power, and an impeller (not shown) positioned in the pump part 14 is rotated. Accordingly, a negative pressure is created in the fuel pump portion 10, and the fuel in the fuel tank is taken into the fuel pump portion 10.

A foreign material in the fuel taken from the fuel tank is removed at the element 22 of the suction filter 20, and the fuel is introduced into the pump part 14 via the intake part 12. In the pump part 14, a pressure of the fuel is raised by rotation of the impeller, and the fuel is introduced into the pump case 30 via the discharge part 18.

The fuel introduced into the pump case 30 is transferred to the fuel filter 36 via the connecting port 303 and the fuel passage 301, and a foreign material in the fuel is removed.

A regulator (not shown) controls a pressure of the fuel of which foreign material is removed at the fuel filter 36, which is positioned radially-outward of the pump case 30, and the fuel is introduced outside the fuel pump module 1. The fuel introduced outside the fuel pump module 1 is introduced into a delivery pipe (not shown) connected to the regulator. An injector supplies the fuel to an intake passage or a cylinder of the engine.

Effects of the first embodiment will be described below.

According to the first embodiment, when an electric power is supplied to the fuel pump portion 10, the motor of the motor part 16 and the impeller in the pump part 14 rotate and produce vibrations. In the fuel pump module 1 according to the first embodiment, the convex part 13 positioned adjacent to the suction filter 20 is inserted in the concave part 46 of the bracket 40. The tip part 131 of the convex part 13 is in contact with the bottom surface 461 of the concave part 46, such that the fuel pump portion 10 is restricted from moving in the axis direction. On the other hand, the clearance 463 is provided between the side surface 132 of the convex part 13 and the side surface 462 of the concave part 46, such that the fuel pump portion 10 is allowed to rotate in a rotation direction around the central axis φ of the fuel pump portion 10. Accordingly, vibration produced by rotation of the fuel pump portion 10 is less likely to be transmitted to the pump case 30 and the like. Therefore, according to the fuel pump module 1 of the first embodiment, a noise produced by the operation of the fuel pump portion 10 is reduced.

According to the first embodiment, the convex part 13 is positioned on the central axis φ of the fuel pump portion 10. Therefore, the convex part 13 is located at the center of the rotation of the fuel pump portion 10, such that vibration produced by the rotation of the fuel pump portion 10 is much less likely to be transmitted. Thus, according to the fuel pump module 1 of the first embodiment, the noise produced by the operation of the fuel pump portion 10 is further reduced.

According to the first embodiment, the bracket 40 has the notch part 411, and the center angle θ of the notch part 411 is smaller than 180°. The connecting part 24 of the suction filter 20 and the intake part 12 of the fuel pump portion 10 are connected with each other at the notch part 411. Accordingly, a relative position of the bracket 40 relative to the fuel pump portion 10 and the suction filter 20 is limited in some degree. Therefore, the bracket 40 produces less noise than a bracket greatly vibrating relative to a fuel pump portion and a suction filter.

Second Embodiment

Figure 4:
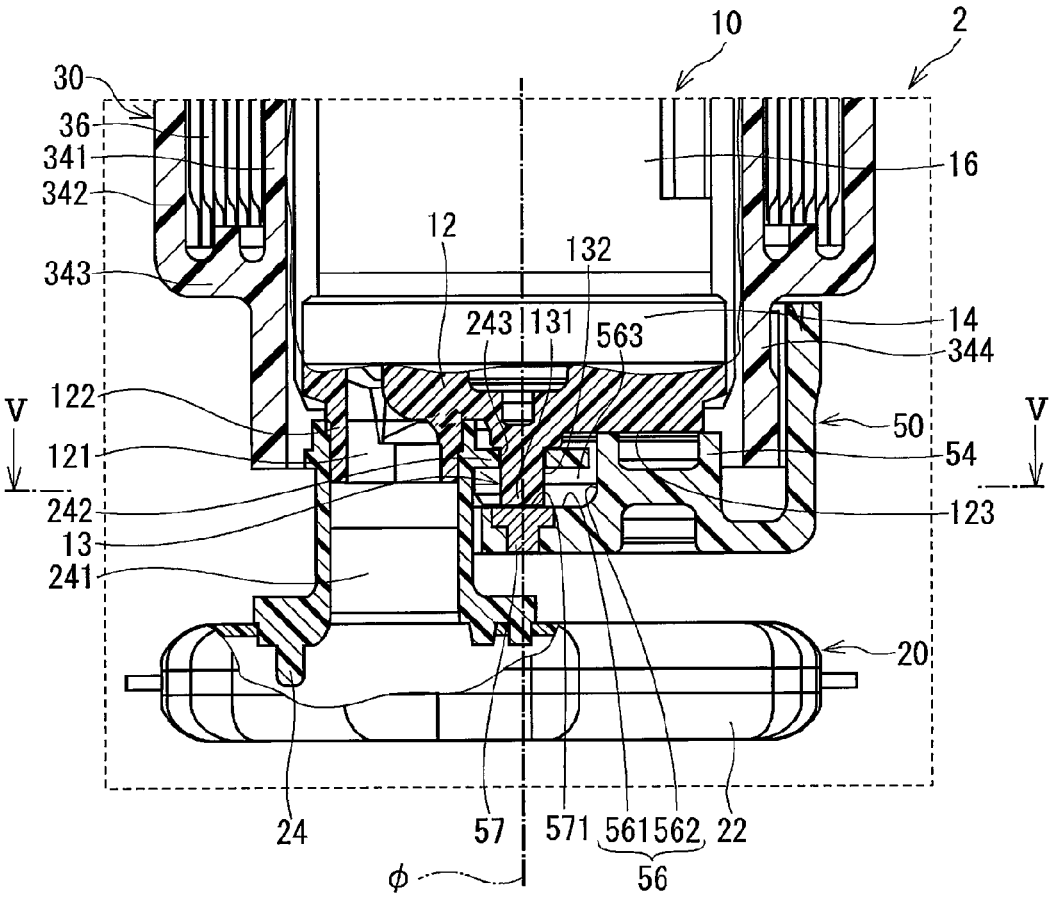
FIG. 4 is an enlarged cross-sectional view illustrating a fuel pump module according to a second embodiment.
Figure 5:
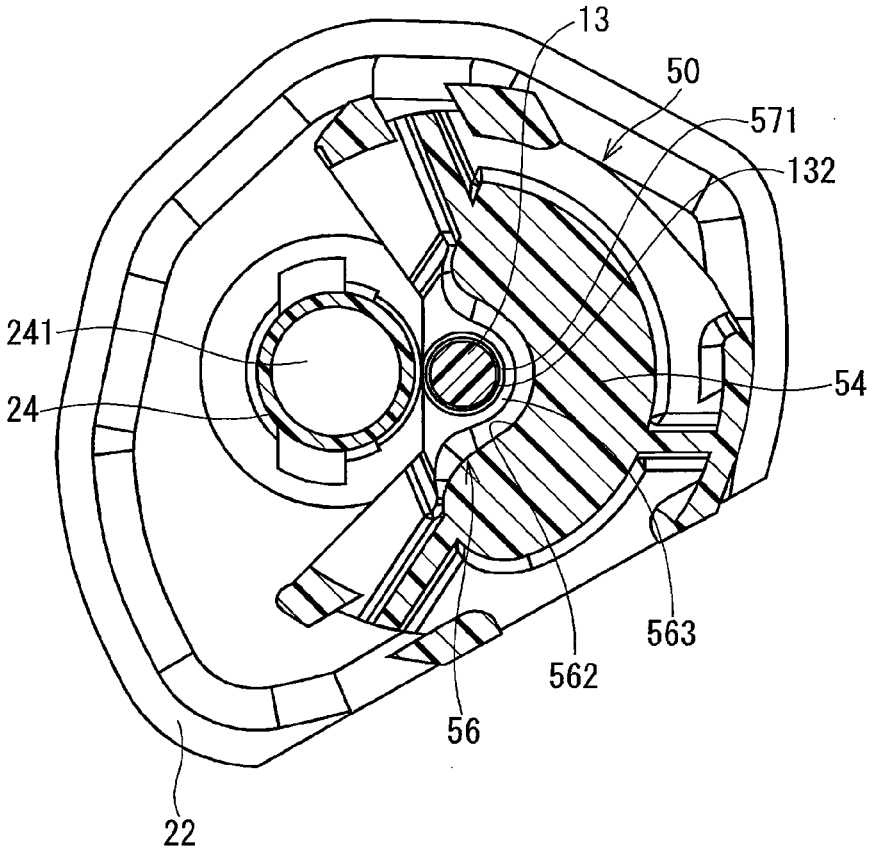
FIG. 5 is a cross-sectional view taken along a line V-V of FIG. 4.

A fuel pump module 2 according to a second embodiment will be described with reference to FIGS. 4 and 5. According to the second embodiment, the fuel pump portion 10 has a bracket 50, and the bracket 50 has a concave part 56 including a bottom surface 561. The bottom surface 561 has a structure different from the bottom surface 461 of the first embodiment.

According to the fuel pump module 2 of the second embodiment, the bottom surface 561 of the concave part 56 of the bracket 50 has a pin 57 made of a metal material. An end surface 571 of the pin 57 adjacent to the fuel pump portion 10 is able to be in contact with the tip part 131 of the convex part 13. The concave part 56 has a side surface 562, which is a wall surface of a radially-inward wall configuring a supporting part 54. A clearance 563 is provided between the side surface 562 and the side surface 132 of the convex part 13 inserted in the concave part 56.

In the fuel pump module 2, when the fuel pump portion 10 vibrates in the axis direction, a load corresponding to a weight of the fuel pump portion 10 is applied to the end surface 571 of the pin 57. The pin 57 is made of a metal material and has resistance to abrasion. The convex part 13 is restricted from making a dent in the end surface 571 as compared to the fuel pump module 1 of the first embodiment, in which the bottom surface 461 of the concave part 46 is made of a resin material. Accordingly, in addition to the advantages of the first embodiment, the fuel pump portion 10 is prevented from moving in the axis direction in the pump module 2 of the second embodiment.

Further, as a separate member, the pin 57 is disposed between the convex part 13 of the fuel pump portion 10 and the concave part 56 of the bracket 50, such that vibrations of the fuel pump portion 10 in the axis direction is less likely to be transmitted to the bracket 50. Therefore, the noise is further reduced.

Third Embodiment

A fuel pump module 3 according to a third embodiment will be described with reference to FIGS. 6 and 7. The fuel pump module 3 includes a clip 70 which connects a bracket 60 and the pump case 30 with each other.

Figure 6:
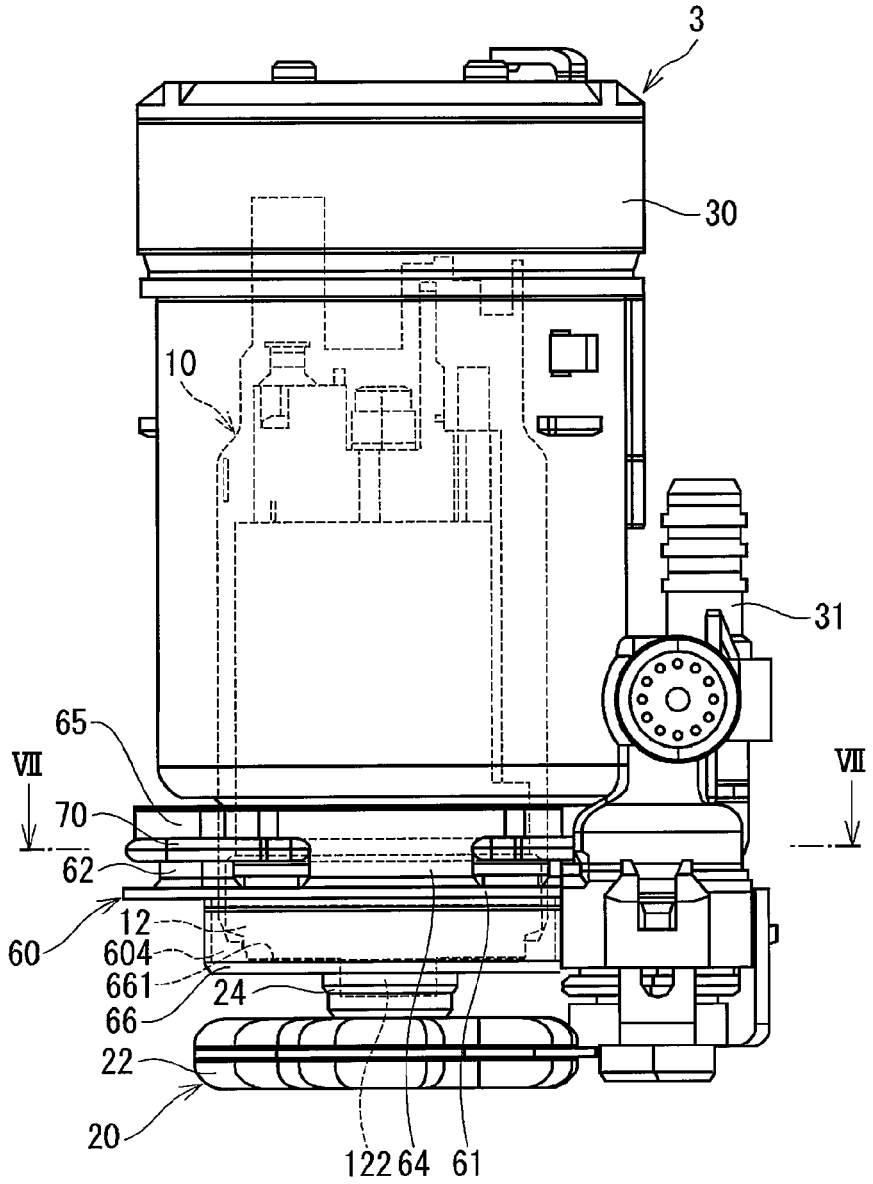
FIG. 6 is a schematic view illustrating a fuel pump module according to a third embodiment.

FIG. 6 is a schematic view illustrating the fuel pump module 3 of the third embodiment. In the fuel pump module 3, the bracket 60 is positioned between the fuel pump portion 10 and the suction filter 20. The bracket 60 is configured by a base 61, a first outer periphery part 62, a second outer periphery part 63, a third outer periphery part 64, a connecting part 65, a cup part 66, and the like.

The base 61 is a flat resin member having a generally C-shape. The first outer periphery part 62, the second outer periphery part 63, the third outer periphery part 64, and the connecting part 65 are configured on a side of the base 61 that is opposite to the suction filter 20. The cup part 66 is located between the base 61 and the suction filter 20.

Figure 7:
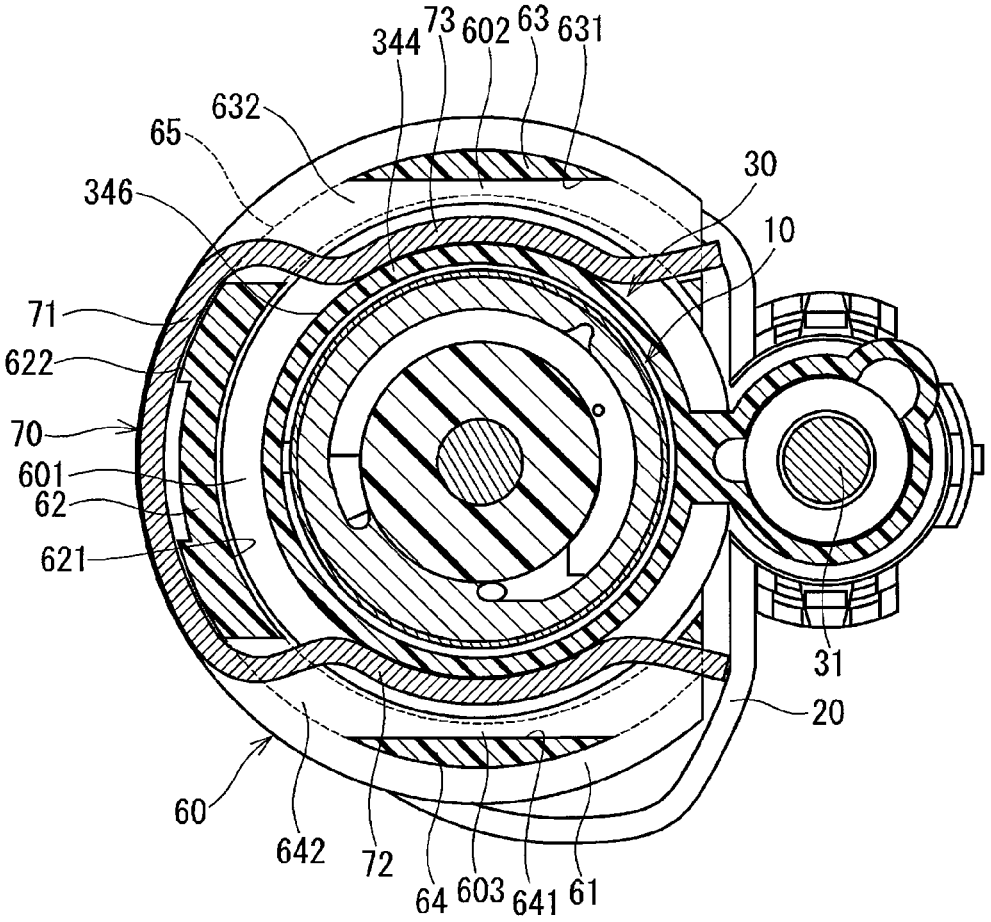
FIG. 7 is a cross-sectional view taken along a line VII-VII of FIG. 6.

As show in FIG. 7, the first outer periphery part 62 has an arc shape. The first outer periphery part 62 is positioned at a location opposite to an outlet port 31 of the pump case 30 through the fuel pump portion 10 and extends along an outer wall of the pump case 30. A clearance 601 is provided between an inner wall surface 621 of the first outer periphery part 62 and the outer wall surface 346 of the opening part 344.

The fuel pump portion 10 is positioned between the second outer periphery part 63 and the third outer periphery part 64 in a direction generally perpendicular to a line extending from the first outer periphery part 62 to the outlet port 31. A clearance 602 is provided between an inner wall surface 631 of the second outer periphery part 63 and the outer wall surface 346 of the opening part 344. Further, a clearance 603 is provided between an inner wall surface 641 of the third outer periphery part 64 and the outer wall surface 346 of the opening part 344.

As shown in FIG. 6, the connecting part 65 is positioned opposite to the base 61 through the first outer periphery part 62, the second outer periphery part 63, and the third outer periphery part 64. As shown in FIG. 7, the connecting part 65 connects the first outer periphery part 62, the second outer periphery part 63, and the third outer periphery part 64 with each other, on the opposite side that is opposite to the base 61.

The cup part 66 has a bottomed-tubular shape. The intake part 12 of the fuel pump portion 10 is inserted into the cup part 66 via an opening provided at the base 61. A clearance 604 is defined between the intake part 12 and an inner wall of the cup part 66 in a radial direction, and the bottom surface 123 is able to be in contact with an inner bottom surface 661 of the cup part 66. A base part of the cup part 66 has a through-hole passing through the base part in a thickness direction, and the intake port defining part 122 is inserted in the through-hole.

As shown in FIG. 7, the clip 70 has a generally U-shape and includes a first holding part 71, a second holding part 72, a third holding part 73, and the like. The first holding part 71, the second holding part 72, the third holding part 73, and the like are made of a metal material and integrated with each other to define the clip 70. The clip 70 connects the bracket 60 and the pump case 30 with each other.

As shown in FIG. 7, the first holding part 71 is disposed to be along with an outer wall surface 622 of the first outer periphery part 62 of the bracket 60.

The second holding part 72 and the third holding part 73 have a generally W-shape. The second holding part 72 is connected to an end of the first holding part 71, and the third holding part 73 is connected with the other end of the first holding part 71.

The third holding part 73 is inserted in a clearance 632, which is provided between the first outer periphery part 62 and the second outer periphery part 63. Further, the third holding part 73 is positioned between the inner wall surface 631 of the second outer periphery part 63 and the outer wall surface 346 of the opening part 344 to be along the outer wall surface 346.

The second holding part 72 is inserted in a clearance 642, which is provided between the first outer periphery part 62 and the third outer periphery part 64. Further, the second holding part 72 is positioned between the inner wall surface 641 of the third outer periphery part 64 and the outer wall surface 346 of the opening part 344 to be along the outer wall surface 346.

The clip 70 is disposed so that the first holding part 71 is in contact with the first outer periphery part 62 of the bracket 60, and that the second holding part 72 and the third holding part 73 are fitted with the pump case 30 from both sides of the pump case 30. Therefore, the bracket 60 is restricted from moving relative to the pump case 30.

According to the fuel pump module 3 of the third embodiment, the fuel pump portion 10 is sandwiched between the pump case 30 and the cup part 66 of the bracket 60 in the axis direction, therefore the fuel pump portion 10 is restricted from moving in the axis direction. Moreover, the intake part 12 of the fuel pump portion 10 is inserted in the cup part 66, and the clearance 604 is provided between the intake part 12 of the fuel pump portion 10 and the cup part 66 of the bracket 60 in the radial direction. Therefore, the fuel pump portion 10 can move in the rotation direction around the central axis φ.

Accordingly, vibration produced by rotation of the fuel pump portion 10 is less likely to be transmitted to the pump case 30 and the like. Therefore, according to the fuel pump module 3 of the third embodiment, a noise produced by the operation of the fuel pump portion 10 is reduced.

Fourth Embodiment

Figure 8:
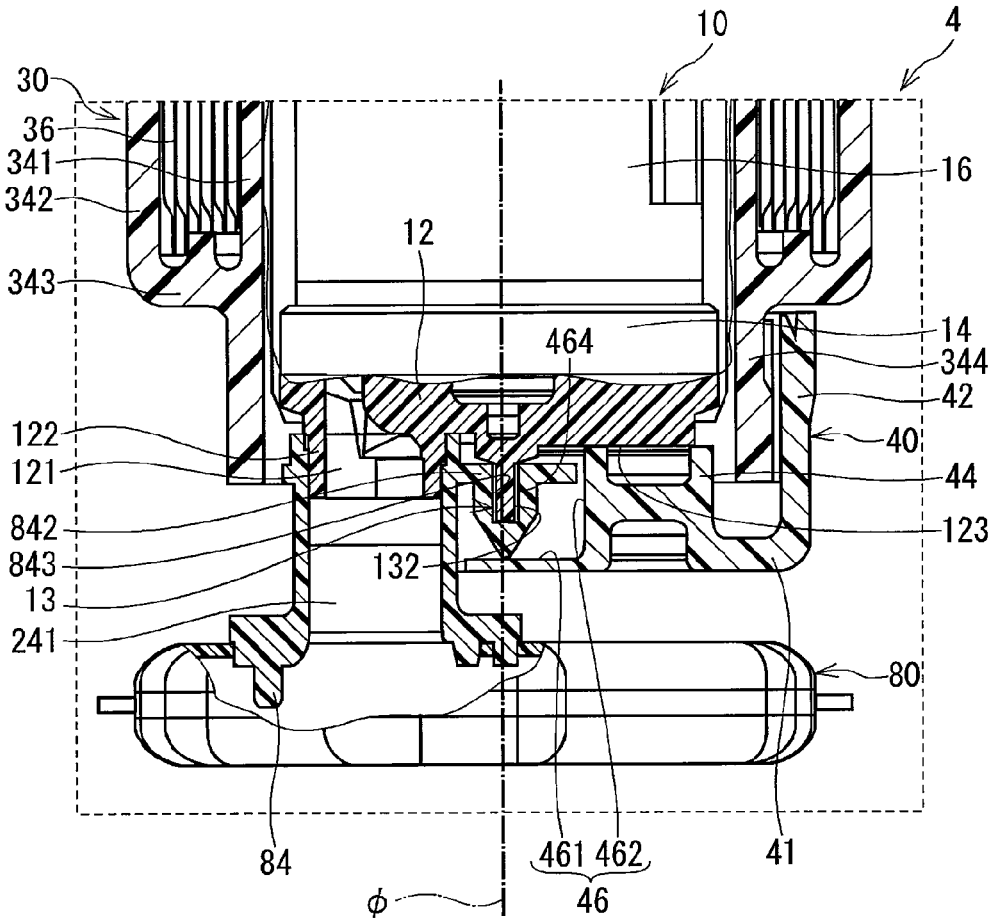
FIG. 8 is an enlarged cross-sectional view illustrating a fuel pump module according to a fourth embodiment.

A fuel pump module 4 according to a fourth embodiment will be described with reference to FIG. 8. According to the fourth embodiment, a relationship between a convex part of a fuel pump portion and a concave part of a bracket is different from that of the first embodiment.

In the fuel pump module 4 of the fourth embodiment, a connecting part 84 of a suction filter 80 has a guide part 842, and the guide part 842 has a bottomed-tubular shape. The guide part 842 may correspond to a bottomed-tubular portion, and provides an insert hole 843 (blind hole) having an opening opposing the fuel pump portion 10. The convex part 13 is inserted in the insert hole 843. When the convex part 13 is inserted in the insert hole 843, a clearance 464 is provided between the side surface 132 of the convex part 13 and an inner wall of the insert hole 843.

A section of the guide part 842 adjacent to the suction filter 80 is defined to have a conical shape, and a tip end of the guide part 842 is in contact with the bottom surface 461 of the concave part 46 of the bracket 40. That is, the guide part 842 is supported, at a single point, by the bottom surface 461 of the concave part 46.

In the fuel pump module 4 of the fourth embodiment, the convex part 13 is in contact with the bottom surface 461 of the concave part 46 via the guide part 842 of the suction filter 80. Accordingly, the fuel pump module 4 of the fourth embodiment can provide the same advantages as the first embodiment.

According to the fourth embodiment, the guide part 842 is supported at the single point by the bracket 40 in the fuel pump module 4. Accordingly, the fuel pump portion 10 and the suction filter 80 can easily rotate around the central axis φ using the single point supporting the guide part 842 as a center of the rotation. Therefore, the noise can be further reduced.

Other Modifications

According to the first, second, and fourth embodiments, the convex part 13 is positioned on the central axis φ.

However, a position of the convex part 13 is not limited, and the convex part 13 may be positioned at a location not overlapping with the central axis φ.

According to the first, second, and fourth embodiments, the bracket is defined to have a generally arc shape including a notch part, and two end surfaces defining the notch part defines a center angle smaller than 180°. However, the shape of the bracket is not limited. The center angle of the notch part may be larger than or equal to 180°, and the bracket may not have the generally arc shape.

According to the first, second, and fourth embodiments, the bracket is disposed separately from the fuel pump portion, the suction filter, and the pump case. However, the bracket is not limited to be disposed separately from those components, and may be integrated with at least one of the fuel pump portion, the suction filter, or the pump case.

Such changes and modifications are to be understood as being within the scope of the present disclosure as defined by the appended claims.

What is claimed is:

1. A fuel pump module comprising:

a suction filter configured to remove a foreign material included in a fuel;

a fuel pump portion configured to raise a pressure of the fuel in the suction filter and discharge the fuel, wherein the fuel pump portion has an end part opposing the suction filter, and a convex part protruding toward the suction filter is at the end part;

a pump case housing the fuel pump portion; and a holding member allowing the fuel pump portion to rotate around a central axis of the fuel pump portion and restricting the fuel pump portion from moving in an axis direction, wherein the holding member is positioned between the fuel pump portion and the suction filter, the holding member has a concave part, in which the convex part is inserted, such that a clearance is defined between the convex part and the concave part in a radial direction, the convex part has a tip part including a tip surface that is in contact with a bottom surface of the concave part in the axis direction, and in the end part of the fuel pump portion, the tip surface is the closest surface of the tip part to the suction filter in the axis direction.

2. The fuel pump module according to claim 1, wherein the bottom surface of the concave part is made of a material which is harder than the tip part of the convex part.

3. The fuel pump module according to claim 1, wherein the suction filter has an element configured to remove the foreign material, and a connecting part connecting the element to the fuel pump portion, the connecting part has a bottomed-tubular portion, the convex part is inserted in the bottomed-tubular portion of the connecting part such that a clearance is defined between the convex part and the bottomed-tubular portion in a radial direction, and the tip part of the convex part is capable of being in contact with the bottomed-tubular portion in the axis direction.

4. The fuel pump module according to claim 1, wherein the holding member is disposed separately from the fuel pump portion, the suction filter, and the pump case.

5. The fuel pump module according to claim 1, wherein the convex part is defined to be located on the central axis of the fuel pump portion.

6. The fuel pump module according to claim 1, wherein the holding member includes a base portion having a notch part, and a wall member extending in the axis direction from the base portion, and the suction filter and the fuel pump portion are connected with each other at the notch part.

7. The fuel pump module according to claim 6, wherein the notch part has a center angle which is smaller than 180°.

8. The fuel pump module according to claim 1, further comprising:

a connecting member connecting the holding member and the pump case with each other.

9. A fuel pump module comprising:

a suction filter configured to remove a foreign material included in a fuel;

a fuel pump portion configured to raise a pressure of the fuel in the suction filter and discharge the fuel, wherein the fuel pump portion has an end part opposing the suction filter, and a convex part protruding toward the suction filter is at the end part;

a pump case housing the fuel pump portion; and a holding member allowing the fuel pump portion to rotate around a central axis of the fuel pump portion and restricting the fuel pump portion from moving in an axis direction, wherein the holding member is positioned between the fuel pump portion and the suction filter, the suction filter has an element configured to remove the foreign material, and a connecting part connecting the element to the fuel pump portion, the connecting part has a bottomed-tubular portion, the convex part is inserted in the bottomed-tubular portion of the connecting part such that a clearance is defined between the convex part and the bottomed-tubular portion in a radial direction, the convex part has a tip part that is capable of being in contact with the bottomed-tubular portion in the axis direction, the bottomed-tubular portion has an open end and a closed end, and the tip part is inserted into the bottomed-tubular portion through the open end to be in contact with the closed end.

* * * * *